US007470225B2

(12) United States Patent
Herrin

(10) Patent No.: US 7,470,225 B2
(45) Date of Patent: Dec. 30, 2008

(54) METHOD FOR FORMING A DOUBLE GLUED CORNER TRAY STRUCTURE

(75) Inventor: Robert M. Herrin, Orlando, FL (US)

(73) Assignee: R&L Manufacturing, Vero Beach, FL (US)

( * ) Notice: Subject to any disclaimer, the term of this patent is extended or adjusted under 35 U.S.C. 154(b) by 0 days.

(21) Appl. No.: 11/875,084

(22) Filed: Oct. 19, 2007

(65) Prior Publication Data

US 2008/0039308 A1 Feb. 14, 2008

Related U.S. Application Data

(62) Division of application No. 10/721,962, filed on Nov. 25, 2003.

(60) Provisional application No. 60/429,319, filed on Nov. 26, 2002.

(51) Int. Cl.
*B31B 1/48* (2006.01)

(52) U.S. Cl. ..... 493/126; 493/127; 493/143; 493/167; 493/210

(58) Field of Classification Search ..... 493/124–127, 493/55, 143, 167, 173–174, 210
See application file for complete search history.

(56) References Cited

U.S. PATENT DOCUMENTS

| | | | |
|---|---|---|---|
| 2,665,836 | A | 1/1954 | Rendall |
| 3,978,774 | A | 9/1976 | Royal |
| 4,174,658 | A | 11/1979 | Graham |
| 4,256,025 | A | 3/1981 | Goda et al. |
| 4,289,491 | A | 9/1981 | Collura et al. |
| 4,418,863 | A | 12/1983 | Kimbrell, Sr. |
| 4,460,349 | A | 7/1984 | Charron |
| 4,500,306 | A | 2/1985 | Nowacki |
| 4,578,054 | A | 3/1986 | Herrin |
| 4,651,501 | A | 3/1987 | Matsuda et al. |
| 4,835,944 | A | 6/1989 | Herrin |
| 4,936,815 | A | 6/1990 | Kirkland |
| 4,988,331 | A | 1/1991 | Boisseau |
| 5,131,208 | A | 7/1992 | Paul et al. |
| 5,452,844 | A | 9/1995 | Bochet |
| 5,782,732 | A | 7/1998 | Herrin |
| 5,797,716 | A | 8/1998 | Herrin |
| 5,807,223 | A | 9/1998 | Holton |
| 5,853,120 | A | 12/1998 | McLeod et al. |
| 5,916,078 | A | 6/1999 | Herrin |

(Continued)

*Primary Examiner*—Christopher Harmon
(74) *Attorney, Agent, or Firm*—Allen, Dyer, Doppelt, Milbrath & Gilchrist, P.A.

(57) ABSTRACT

A paper board blank is formed into a tray having a double glued side wall construction for providing a desirable strength to the tray. A platen drives the blank through forming rails which fold the blank into a partially formed tray having bottom, end and side walls, and inside corner supports formed about the platen. After the platen is retracted, a first folding arm folds a top wall portion to a position generally parallel to the bottom panel. A second folding arm then folds end fold portions of outside corner supports into a passage formed between a compression plate and a fixed guide plate, wherein the fixed guide plate provides a guiding surface. The compression plate is then biased against each of the side fold portions for compressing the side fold portions against the side panels to form the tray.

16 Claims, 10 Drawing Sheets

U.S. PATENT DOCUMENTS 5,971,906 A 10/1999 Tharpe et al.
5,979,746 A 11/1999 McLeod et al.
6,226,965 B1 5/2001 Lam
6,306,070 B1 10/2001 Herrin
6,422,802 B1 7/2002 Herrin
6,622,461 B2 9/2003 Gambetti FIG. 3
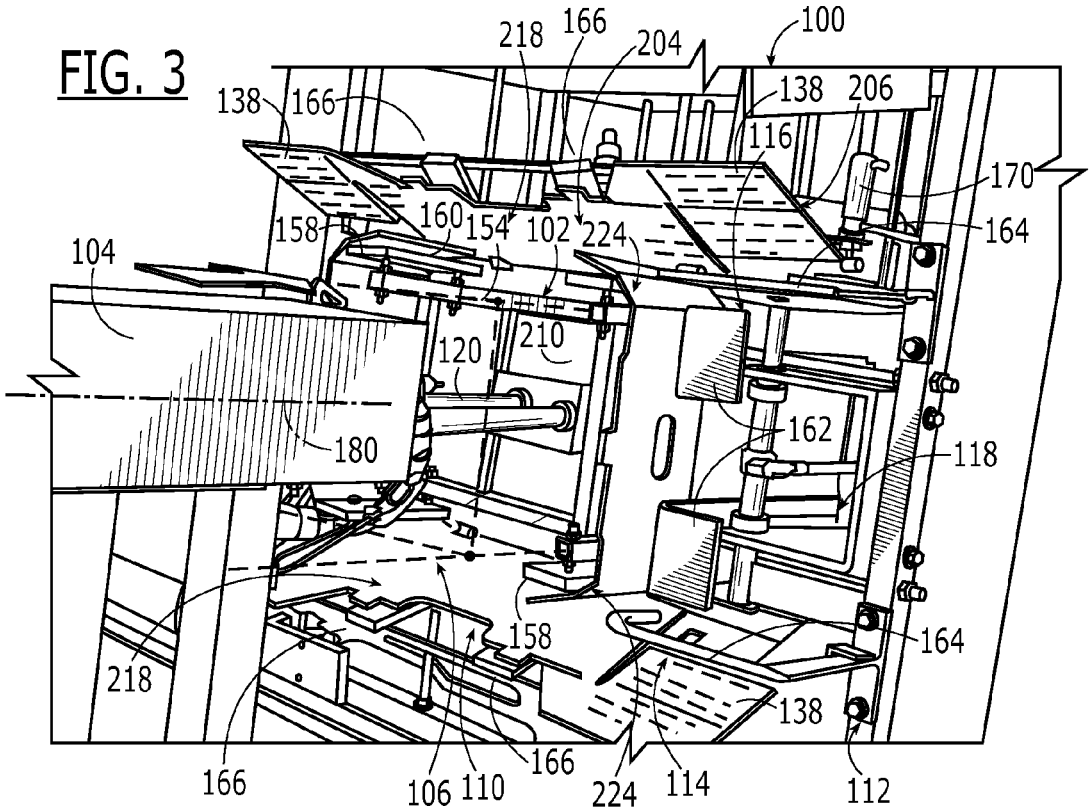
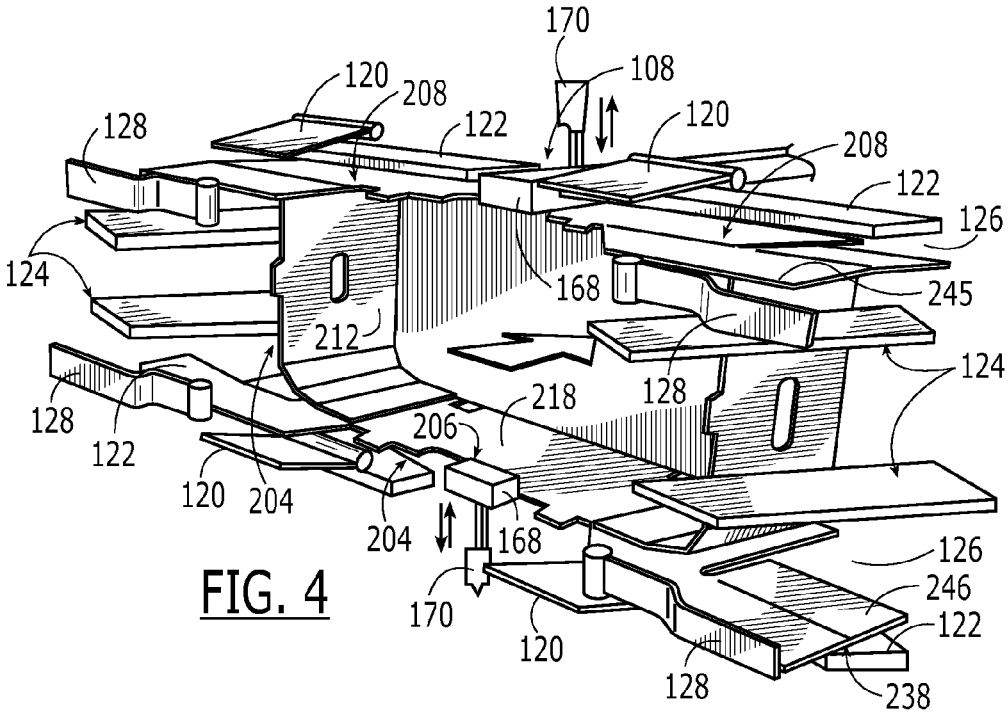
FIG. 4

METHOD FOR FORMING A DOUBLE GLUED CORNER TRAY STRUCTURE

CROSS REFERENCE TO RELATED APPLICATIONS

This application is a divisional of application Ser. No. 10/721,962 filed Nov. 25, 2003 which incorporates by reference and claims priority to application Ser. No. 60/429,319 filed Nov. 26, 2002 for "Tray Forming Apparatus And Method Of Forming A Double Glued Corner Tray Structure".

FIELD OF THE INVENTION

The present invention generally relates to container fabrication systems, and in particular to a container forming apparatus and automated method of forming a container having a reinforced corner construction from a scored blank.

BACKGROUND OF THE INVENTION

It is well known in the art to use paperboard trays for stacking during delivery to a final destination such as a grocery store and for displaying products such as citrus within the tray as describe in U.S. Pat. No. 5,971,906 for a Tray Forming Apparatus and Method. Such trays are typically formed from a single blank which has been suitably cut, scored and perforated to be folded into a completed tray or container for subsequent filling of product and shipping. There remains a demand in the industry to strengthen the tray to overcome damage during stacking and delivery when carrying product, to reduce the time necessary to fabricate the tray, and as a result the associated costs.

By way of example, in an effort to strengthen such trays formed from a blank, a reinforced corner construction has been developed and is described in U.S. Pat. Nos. 5,853,120 and 5,979,746 to McLoud et al. which describe a container tray having corner reinforcing structures formed from a flat blank. While it is understood that reinforcing corners using multiple flaps or folds within the blank is desirable, it is also time consuming to fabricate such a structure. There remains a need to automatically form containers from flat blanks.

SUMMARY OF THE INVENTION

The present invention is directed to an apparatus and method for forming a blank into a tray having a reinforced corner construction. One embodiment of the apparatus may include a platen dimensioned for biasing against a blank and a platen drive for moving the platen between a first position proximate and in spaced relation to the blank and a second position through a biasing of the platen against the blank and a driving the blank downstream. A forming rail may be positioned downstream the first position for receiving the blank moving thereby and folding portions of the blank with a proximal portion of the forming rail partially folding peripheral portions of the blank and a distal portion of the forming rail securing the blank into a partially formed tray. A first folding arm is movably positioned for biasing against an extended portion of the partially formed tray. A compression plate may be movably carried in spaced relation to the partially formed tray and a fixed plate may be carried in spaced relation to the compression plate so as to form a passage. A second folding arm is movably positioned for biasing against the extended portion of the partially formed tray and for folding the extended portion through the passage, with the first and second folding arms and the compression plate biased against the fully folded tray to cause an adhesion of corner portions of the tray and thus a fully formed tray having a double glued side wall construction.

A method aspect of the invention may include forming a tray by providing a blank having portions thereof forming a bottom panel, first and second opposing end panels attached to the bottom panel, and first and second opposing side panels attached to the bottom panel, wherein each of the opposing end panels has an inside corner support member attached to opposing edges of each of the opposing end panels, each of the opposing side panels having a top wall portion attached thereto, and wherein an outside corner support member is attached to the top wall portion, the outside corner support member having an end fold portion and a side fold portion, moving the blank through a forming rail and folding the end panels and the side panels upwardly from the bottom panel, further folding the blank into a partially formed tray configured with the end and side panels positioned generally orthogonal to the bottom panel, and wherein each of the top wall portions and outside corner support members are generally parallel to respective side panels thereof, folding the top wall portion to a position generally parallel to the bottom panel, folding the end fold portion into a passage formed by opposing plates, wherein the side fold portion is partially folded by contacting one of the opposing plates providing a guiding surface, and compressing the side fold portions against the side panels so as to form a fully formed tray.

Yet another method aspect may comprise biasing a platen against the bottom panel so as to move the blank through a forming rail positioned for folding the end panels and the side panels, wherein each inside corner support member is folded inwardly of the opposing side panels, further advancing the platen to a position wherein a distal portion of the forming rail secures the blank into a partially formed tray, the partially formed tray being configured with the end and side panels positioned generally orthogonal to the bottom panel, and wherein each of the top wall portions and outside corner support members are generally parallel to respective side panels thereof, retracting the platen from the partially formed tray, positioning a compression plate in spaced relation to a fixed plate for forming a passage therebetween, biasing a first folding arm against the top wall portion for folding the top wall portion into the passage and to a position generally parallel to the bottom panel, wherein the side fold portion is partially folded by contacting the fixed plate, biasing a first folding arm against the top wall portion and folding the top wall portion to a position generally parallel to the bottom panel, biasing a second folding arm against the end fold portion of the outside corner support member and folding the end fold portion into the passage and against the end panel, wherein the side fold portion is partially folded by contacting the fixed plate, and biasing the compression plate against each of the side fold portions for compressing the side fold portions against the side panels, thus forming a fully formed tray.

An adhesive may be applied to a surface of the blank along each of the outside corner members and portions of the side panels proximate prior to moving the blank into the forming position. Alternatively, adhesive may be supplied with the blank.

A method may further comprising controlling a space between the fixed plate and the compression plate to be less than a width dimension of the outside corner support member, wherein a partially folded corner support member when folded along the sixth folding line folds to a position against the fixed plate due to the space between the fixed plate and the compression plate. Yet further, a bevel may be formed within the inside corner support member through a folding thereof, wherein the platen includes bevelled corners, and wherein the inside corner support member includes a fourth fold line therein.

BRIEF DESCRIPTION OF THE DRAWINGS

A preferred embodiment of the invention, as well as alternate embodiments are described by way of example with reference to the accompanying drawings and photographs in which:

FIG. 3 is a partial front right perspective view of the apparatus of FIG. 1:

FIG. 4 is a partial top perspective view illustrating a partially formed tray positioned for folding elements thereof using associated folding elements of the apparatus of FIG. 1;

DETAILED DESCRIPTION OF THE PREFERRED EMBODIMENTS

The present invention will now be described more fully hereinafter with reference to the accompanying drawings, in which embodiments of the invention are shown. This invention may, however, be embodied in many different forms and should not be construed as limited to the embodiments set forth herein. Rather, the embodiments herein presented are provided so that this disclosure will be thorough and complete, and will fully convey the scope of the invention to those skilled in the art.

Figure 1:
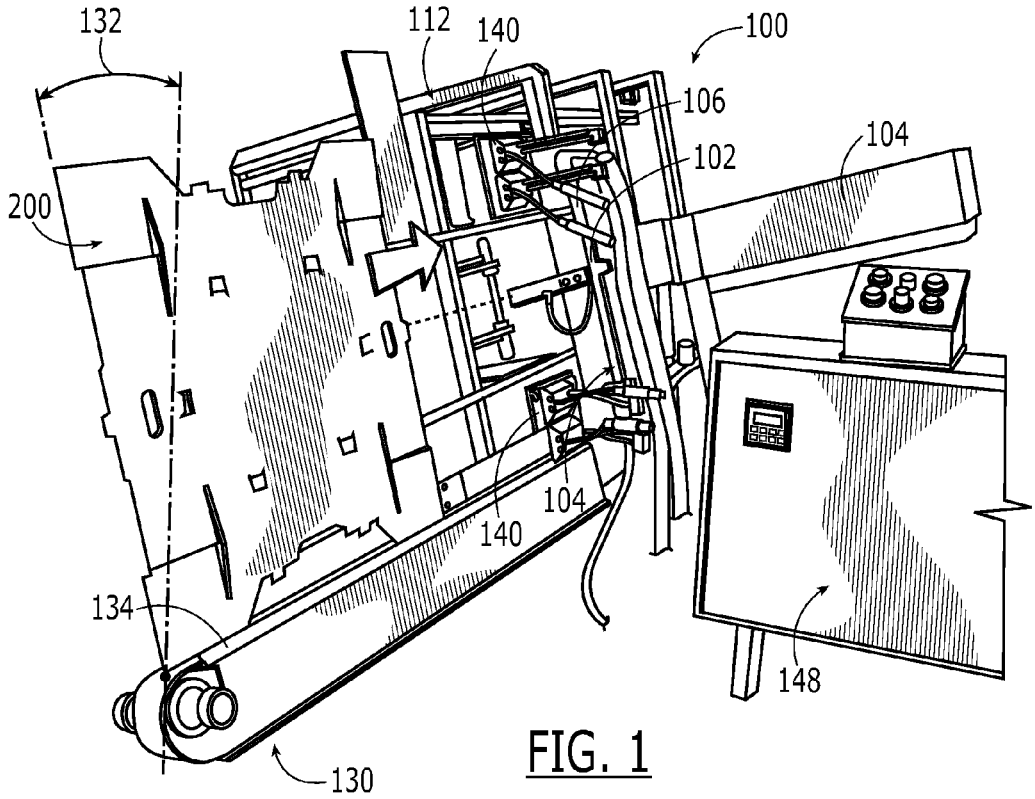
FIG. 1 is a partial front left perspective view of one tray forming apparatus in keep with the teachings of the present invention.
Figure 2:
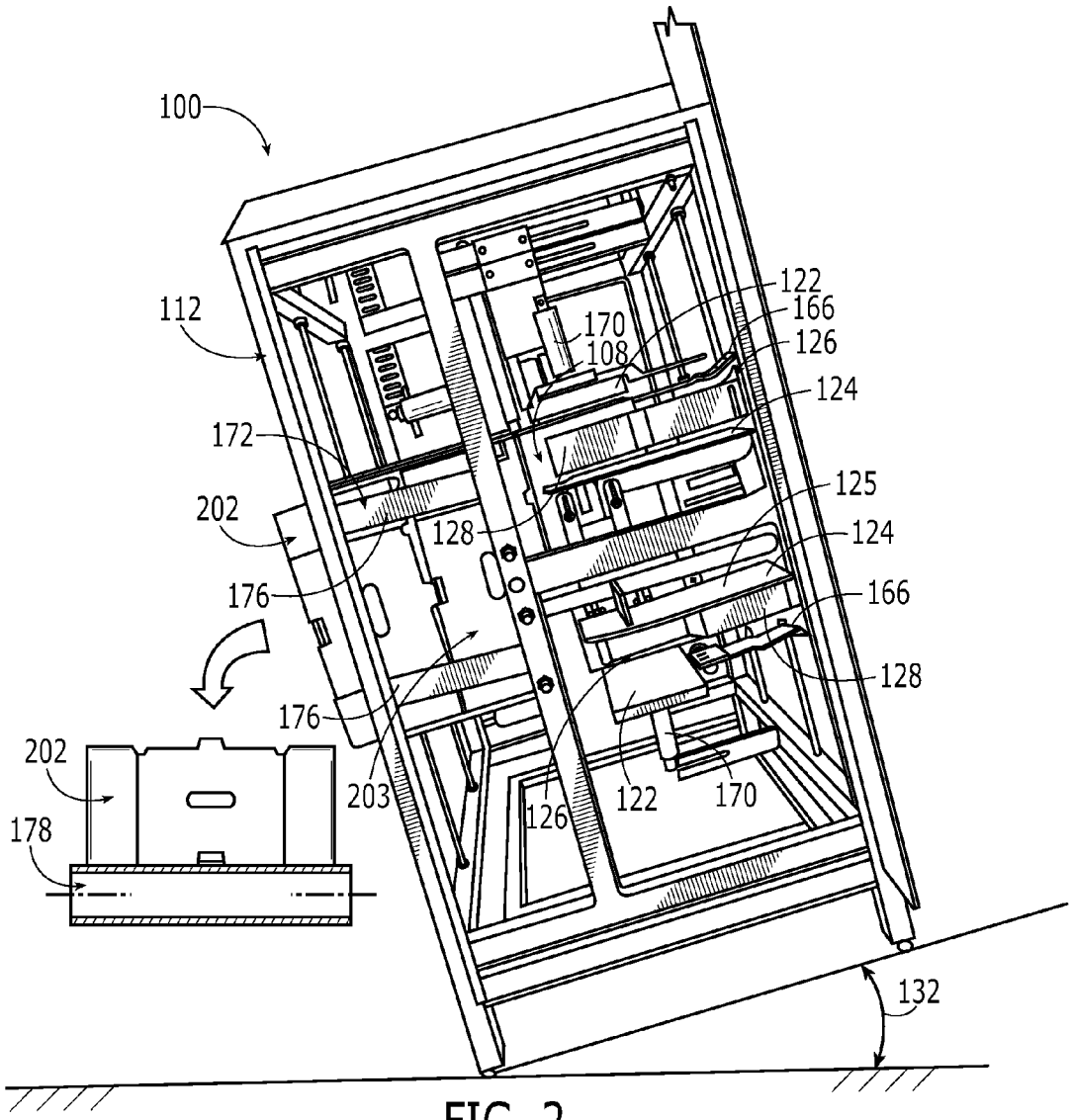
FIG. 2 is a partial side elevation view of the apparatus of FIG. 1.

By way of example, and with reference initially to FIGS. 1 and 2, one embodiment of the present invention includes a tray forming apparatus 100 for forming a blank 200 into a fully formed tray 202. The apparatus 100 may further be described to include a platen 102 dimensioned for biasing against the blank 200 using a platen drive 104 operable for moving the platen between a first position 106 proximate and in spaced relation to the blank 200 and a second position 108, illustrated with reference again to FIG. 2, through an initial movement and biasing of the platen against the blank for driving the blank downstream the first position, as illustrated with reference to FIG. 3. As illustrated with continued reference to FIG. 1, a frame 112 carried the drive 104 as well as other forming elements and operable devices of the apparatus 100 later described in this section.

Figure 5:
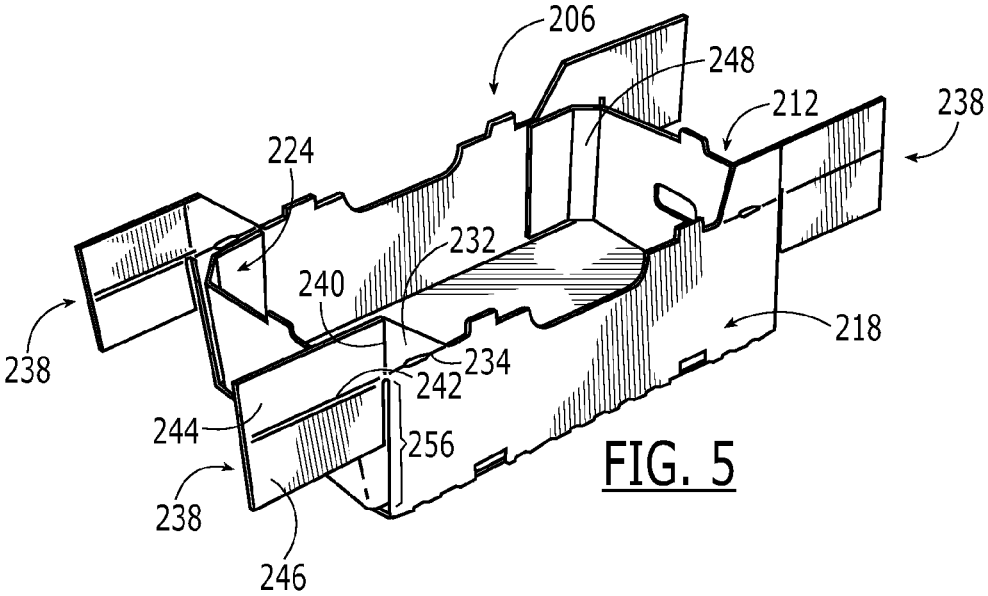
FIG. 5 is a top perspective view of the partially formed tray of FIG. 4.

With continued reference to FIG. 3, a forming rail 114 is positioned downstream the first position 106 for receiving the blank 200 and folding peripheral portions 204 thereof, wherein a proximal portion 116 of the forming rail partially folds the peripheral portions 204 of the blank and a distal portion 118 of the forming rail secures the blank as a partially formed tray 206, illustrated with reference to FIGS. 4 and 5, to be further detailed later in this section. With continued reference to FIG. 4, a first folding arm 120 is pivotally carried by the frame 112 and positioned for biasing against an extended portion 208 of the partially formed tray 206 for a folding thereof, the first folding arm 120 being positioned proximate and downstream the distal portion 118 of the forming rail 114, as illustrated with reference again to FIG. 3. A compression plate 122 is pivotally carried by the frame 112 and in a spaced relation to the partially formed tray 206. A fixed plate 124 is carried in a spaced relation to the compression plate 122 to form a passage 126, to be further detailed later in this section. A second folding arm 128 is carried by the frame 112 and positioned for pivoting and biasing against the extended portion 208 of the partially formed tray 206 for folding the extended portion through the passage 126.

With reference again to FIG. 1, an in-feed conveyor 130 may be used for conveying the blank 200 to the first position 106. BY way of example, one embodiment may include the conveyor 130 placing the blank 200 at an angle 132 to vertical, and thus in a non-vertical orientation for permitting gravity to slidably hold the blank against a surface of the conveyor while conveying the blank on a rotating belt 134. It is to be understood that the apparatus 100 may be operated with the blank entering at a horizontal orientation as well as the angle position herein described.

Figure 6:
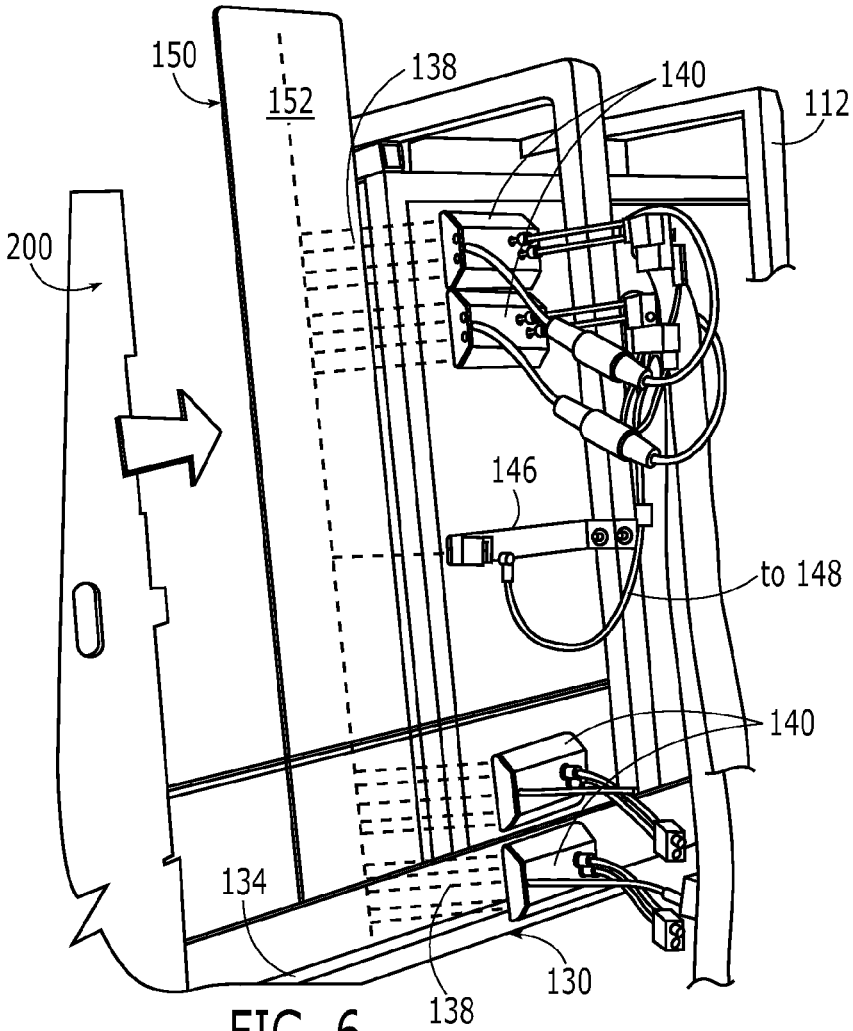
FIG. 6 is a partial enlarged front left perspective view of an adhesive application portion of the apparatus of FIG. 1.

With continued reference to FIG. 1, and to FIG. 6, the apparatus 100 herein described, by way of example, may include a hot glue applicator 136 for applying an adhesive 138 to the blank 200, as illustrated with reference to FIG. 7. In one embodiment, as herein described by way of example, multiple glue heads 140 may adjustably carried by the frame 112 for providing a specific spray pattern at a specific glue head temperature and thus a temperature of the glue for allowing the last surface to be glued to have a soft glue sufficient for making appropriate attachment as the first glued surface during the folding and compressing of the blank to form the tray. A sensor 146 is positioned for sensing a leading and a trailing edge of the blank 200 for providing a signal to a controller 148 for a timely directed allocation activation signal to allow the adhesive 138 to be applied as desired, such as illustrated with reference again to FIG. 7. With reference again to FIG. 6, the glue heads 140 are directed toward a backstop 150 having a roughened surface 152 for receiving any adhesive 138 that may miss hitting the blank 200. The roughened surface 152 allows any adhesive collected thereon to be easily removed when dry. It will be appreciated by those skilled in the art that alternate adhesive methods may be employed, now having the benefit of the teachings of the present invention. By way of example, stapling may be employed in conjunction with the various folding and biasing steps in forming the tray. Yet further, an adhesive may be carried by the blank that is responsive to temperature or pressure for activation. Similarly, various shaped blanks having various constructions may be used to form a container having a desirable shape, now given the teachings of the present invention.

Figure 7:
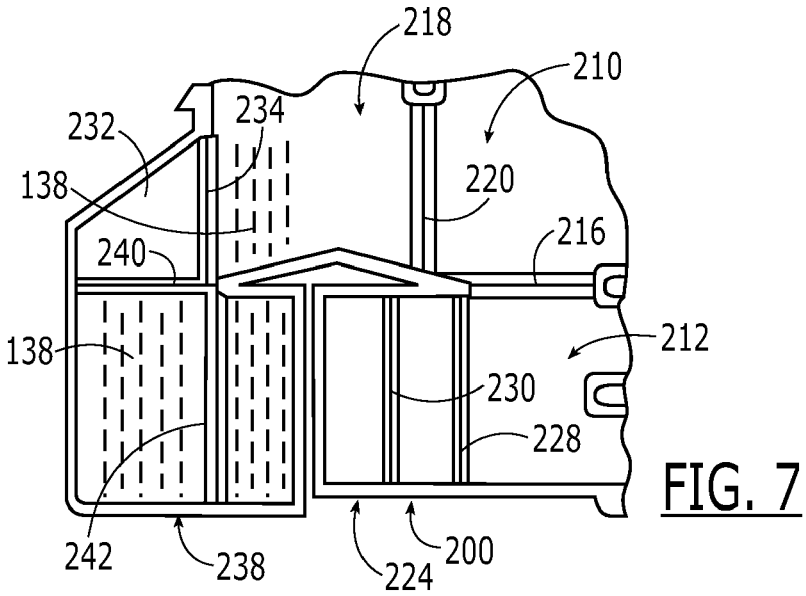
FIG. 7 is a partial plan view of a corner portion of the blank of FIG. 5 illustrating one embodiment of an adhesive applied thereto.
Figure 8:
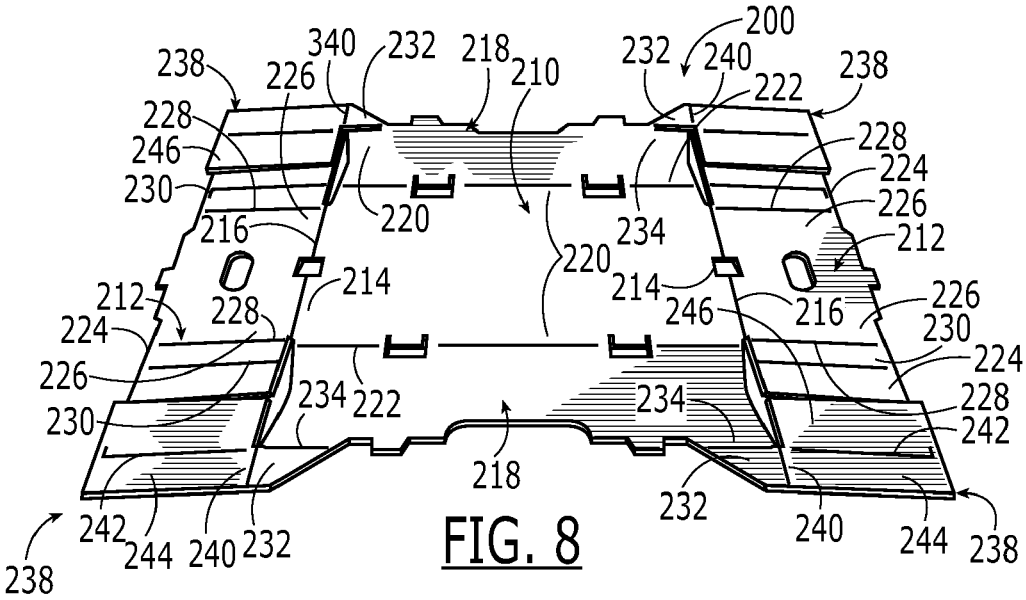
FIG. 8 is a top front perspective view of a paperboard blank having a plurality of fold lines and cuts for forming the blank into a tray through a plurality of folding operations.

To more fully describe aspects of the invention, the paperboard blank 200, as illustrated further with reference to FIG. 8 is herein described by way of example only. The blank 200 may be described to include a bottom panel 210 with first and second opposing end panels 212 formed at opposing peripheral end portions 214 of the bottom panel via first fold lines 216. First and second opposing side panels 218 are connected to opposing peripheral side portions 220 of the bottom panel 210 via second fold lines 222. An inside corner support member 224 is attached to opposing edges 226 of each of the opposing end panels 212 via a third fold line 228. In an optional construction, herein described by way of example, the inside corner support member 224 includes a fourth fold line 230 for forming a bevel within the tray construction. A top wall portion 232 is attached to opposing edges 234 of each opposing side panel 218 via a fifth fold line 236. Further for the blank 200 herein described by way of example, an outside corner support member 238 is attached to each of the top wall portions 232 via a sixth fold line 240, wherein the outside corner support member 238 includes a seventh fold line 242 for providing an outside corner support via an end fold portion 244 and a side fold portion 246. The above further illustrated with reference again to the single corner portion of FIG. 7.

Now having described the blank 200 more fully, embodiments of the apparatus 100 may be further described through detailed illustration. By way of example, and with reference again to FIG. 7, the platen 102 may comprise a rectangular peripheral portion dimensioned for folding the rectangular shaped bottom panel 210 of the blank 200 into a rectangular shape. In one embodiment of the blank 200, above described, the peripheral portion 154 of the platen 102 includes bevelled corners 156, as illustrated with reference again to FIG. 5, and to FIG. 9 to form the bevel 248 within the inside corner support member 224. The platen 102 is dimensioned and aligned to fit proximate the first and second fold lines 216, 222 when contacting the bottom panel 210. It is to be understood that while the inside corner support member is herein described by way of example as having a bevel portion, alternatively it may have a single fold to form a squared inside corner. It will be further understood that while the corner construction herein described in relation to the end panel and the side panel, the tray may be constructed in a mirror image or with reference to alternative end and side panels forming the tray.

Figure 9:
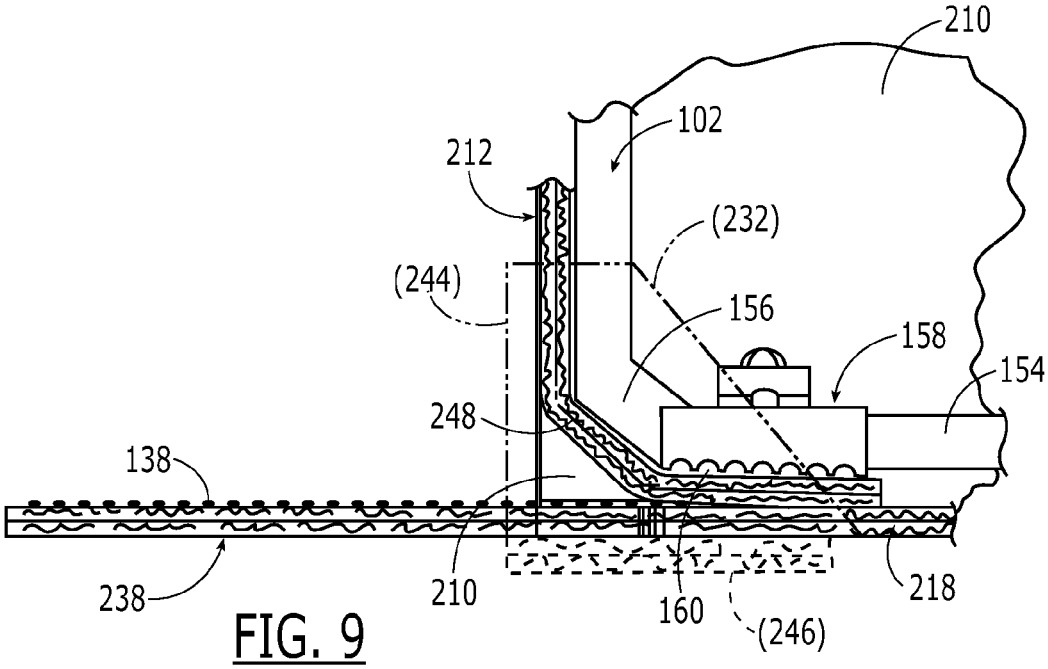
FIG. 9 is a partial top plan view of one corner portion of the partially formed tray of FIG. 5 illustrating one embodiment of a platen used to move the blank downstream through a portion of the tray forming process.

With continued reference to FIGS. 7 and 9, a guide plate 158 is carried by the platen 102 for further defining the platen peripheral portion 154 and for providing a compression surface 160 operable with the inside corner support member 224. The compression surface 160, as herein described by way of example, may comprise depressions for reducing a frictional contacting surface thereof. The corrugations on the compression side of the guide plates reduce the surface area for providing increased pressure on glue points while at the same time reducing friction between the guide plate surface and the tray inside wall to allow the platen to be more easily removed when being retracted, as earlier described.

By way of further example for the tray 202 herein desired, and with reference again to FIG. 3, the inside corner support member 224 is folded to about 90° while the side panel 218 is folded upward approximately 30°-45°. Next the end panel 212 is folded up approximately 90° and the side panel 218 is brought up to a 90° fold compressing the side panel, having the adhesive 138 thereon, against the inside corner support member 224 having the guide plate 158 against it. As a result, the rectangular structure of this sample tray is formed. Each guide plate 158 may includes adjustment screws for aligning the guide plate and positioning the corrugated surface 160 of the guide plate for a desired attitude when compressing varying styled trays. As a result an adjustable platen is provided.

Again using the blank 200, by way of example to more fully describe elements of the embodiment herein presented, reference is again made to FIG. 3 wherein the forming rail 114 may include opposing end folding rails 162 positioned for receiving the end panels 212 and dimensioned for upwardly folding them from the bottom panel 210. Opposing edge rails 164 are positioned for inwardly folding outside edge portions, the inside corner support members 224, herein described by way of example. Opposing side folding rails 166 are positioned for receiving the side panels 218 of the blank 200 and for folding the side panels upwardly from the bottom panel 210 while capturing the inside corner support members 224 therebetween. As earlier described, the blank 200 is received at proximal portions 116 of the forming rail 114, and a distal portion 118 thereof secures the now partially formed tray 206. The forming rail 114 folds the end panels 212 about the first fold lines 216 and the side panels 218 about the second fold lines 222, with each inside corner support member 224 folded about the third fold line 228 inwardly of the opposing side panels 218. The partially formed tray 206 is configured with the end panels 212 and the side panels 218 positioned generally orthogonal to the bottom panel 210 and each of the inside corner support members 224 folded about the third fold line 228 and in juxtaposition with the side panel, as illustrated with reference again to FIGS. 5 and 9. Each of the top wall portions 232 and the outside corner support members 238 are generally parallel to respective side panels 218 thereof.

With reference again to FIG. 4, a locking arm 168 is operable with the folding rail described with reference to FIG. 3 for securing the partially formed tray 206 at the second position 108, herein shown separately for clarity.

Figure 10:
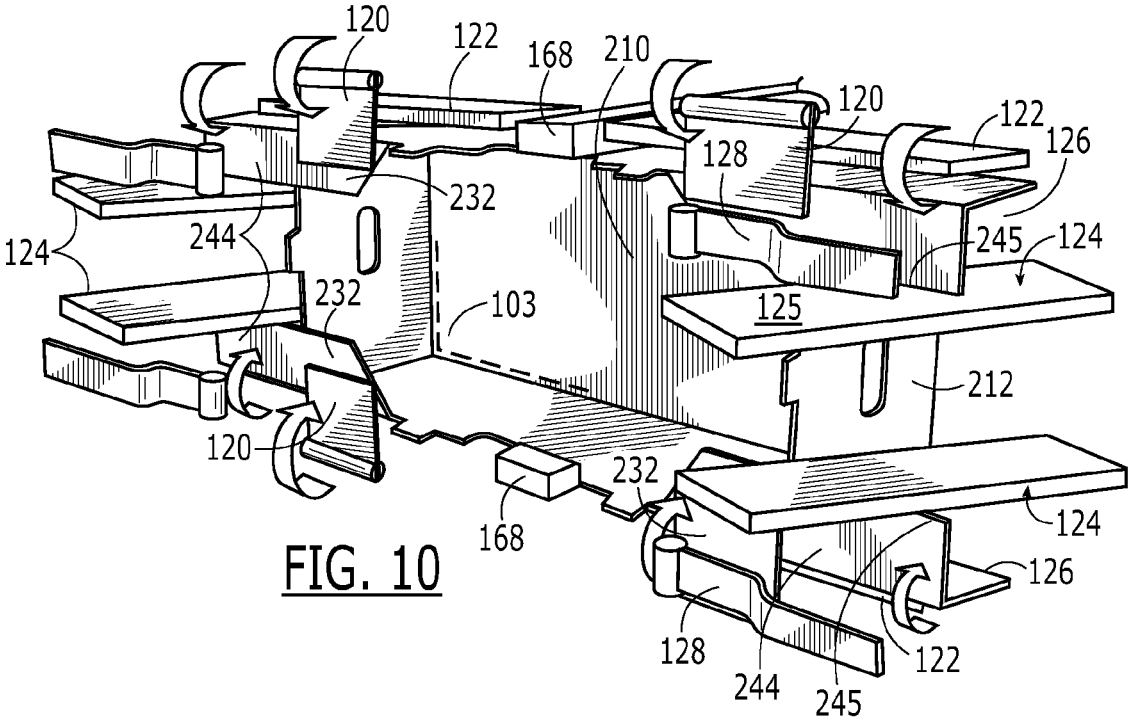
FIG. 10 is a partial perspective view illustrating a first folding arm operable on the partially formed tray.
Figure 11:
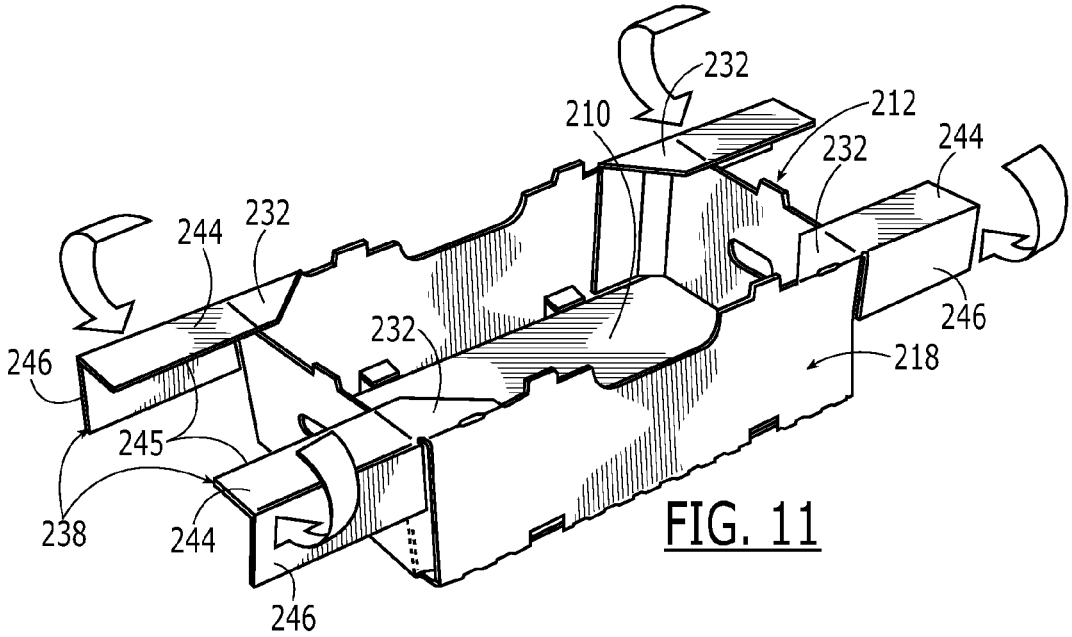
FIG. 11 is a top perspective view of the partially formed tray resulting from the folding process of FIG. 10.
Figure 12:
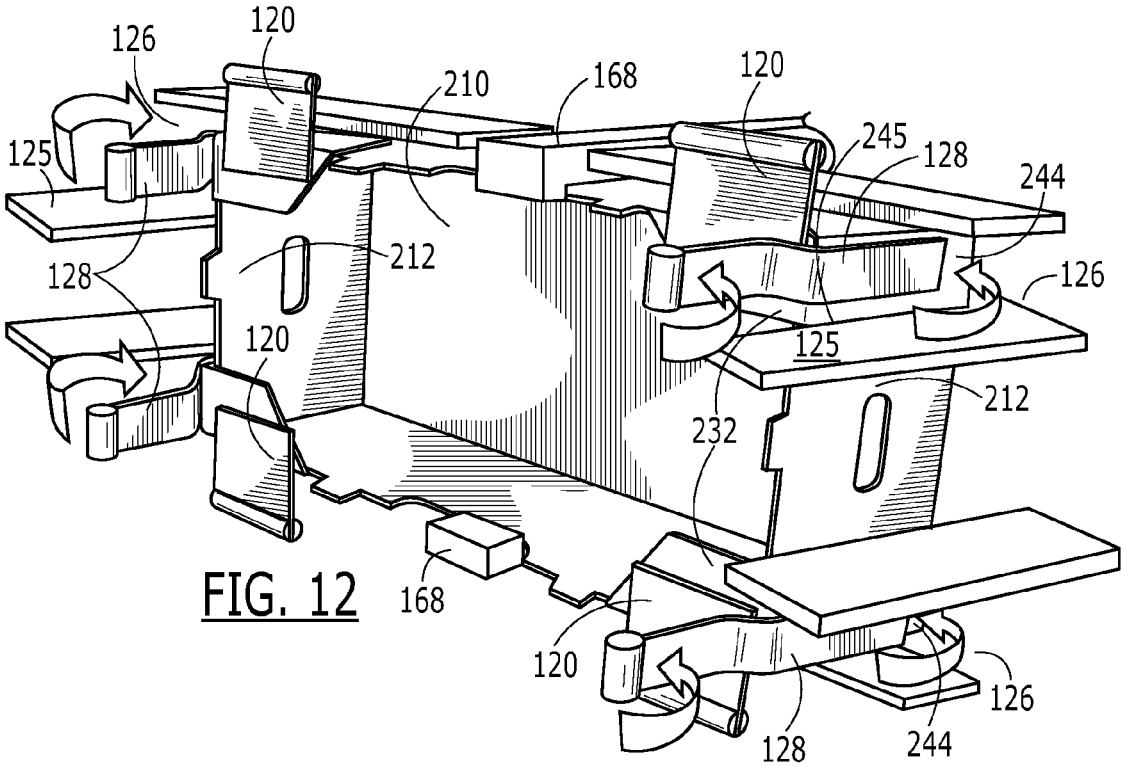
FIG. 12 is a partial top perspective view illustrating elements of the apparatus of FIG. 1 securing a fully formed tray therein.
Figure 13:
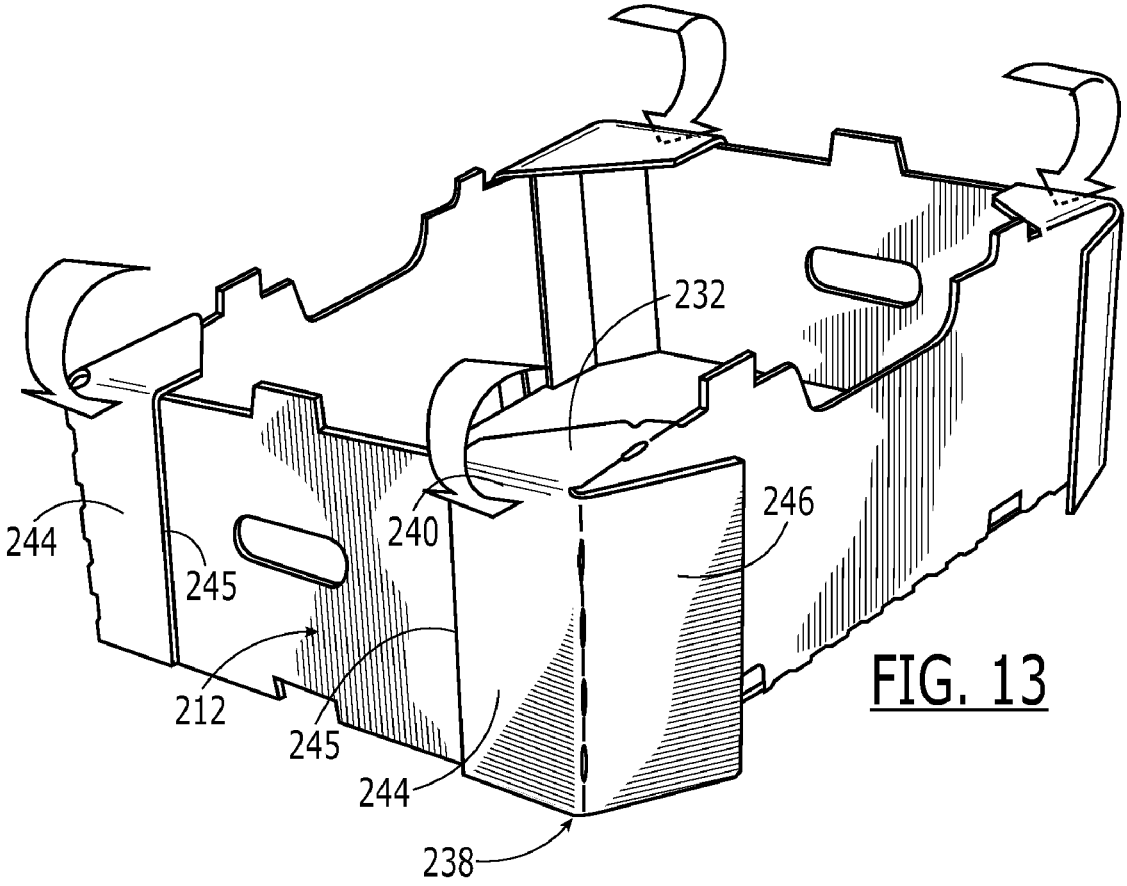
FIG. 13 is a top perspective view of the partially formed tray resulting from the folding process of FIG. 12.
Figure 14:
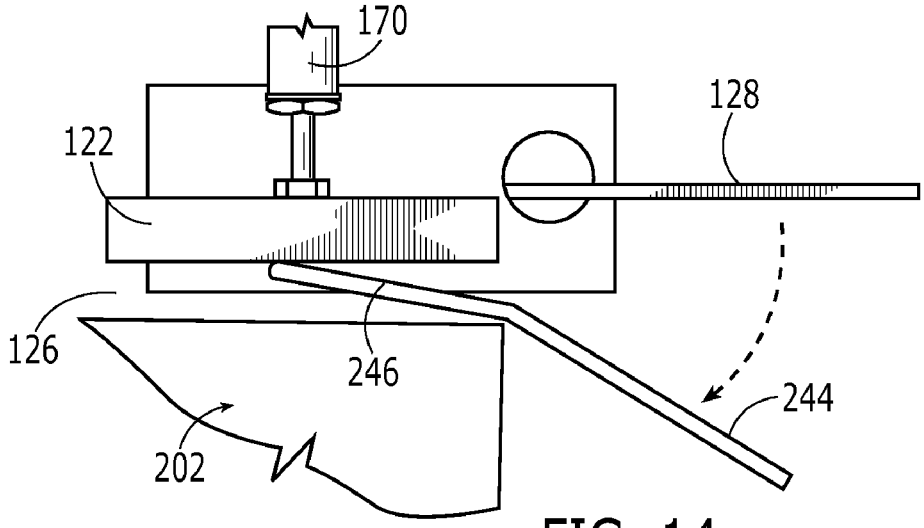
FIG. 14 is a partial perspective view illustrating a first folding arm operable on the partially formed tray.
Figure 15:
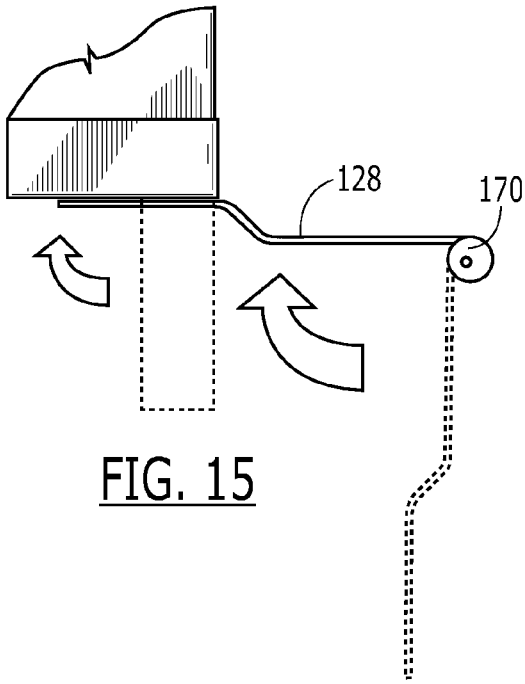
FIG. 15 is a partial perspective view illustrating a second folding arm operable on the partially formed tray.

With the partially formed tray 206 secured in the second position 108, as illustrated with reference again to FIG. 4, by way of example, the platen 102 is retracted and the folding of the top wall portions 232 and the outside corner support members 238 commence. With reference again to FIG. 2, and to FIGS. 10 and 11, the first folding arm 120 is operable for folding the top wall portion 232 about the fifth fold line 236 to a position generally parallel to the bottom panel 210. The side fold portion 246 is partially folded about the sixth fold line 240 by passing through the passage 126 formed by the spaced compression plate 122 and the fixed plate 124. As earlier described, the compression plates 122 are moveable for biasing against each of the side fold portions 246. A squared inside corner is illustrated by way of example in FIG. 10, wherein a squared corner platen 103 would be employed.

For the double-glued corner construction, herein described, the partial folding of the side fold portion 246 has been shown to improve on the performance and speed in the forming process. The fixed plate 124 allows the outside corner support member 238 to stay oriented relative to a plane of the top wall portion 232 resulting in a "squared off" corner construction with vertical walls providing a desired strength needed during stacking of filled trays. By way of example, damage to fruit is avoided especially for the lower trays in the stack. It is to be understood that while the compression plate as herein described is used for both a guide plate to form the passage and a compression plate during movement thereof, alternatively a separate compression plate may be used in conjunction with a separate passage.

Figure 16:
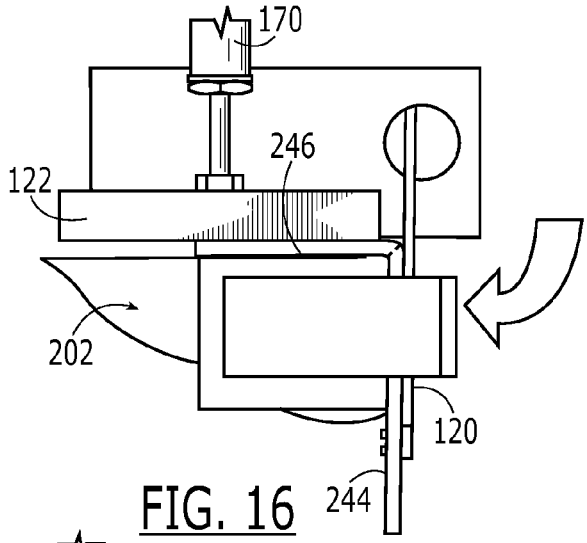
FIG. 16 is a partial end view illustrating an orientation of a compression plate and a first folding arm prior to a folding movement thereby.
Figure 17:
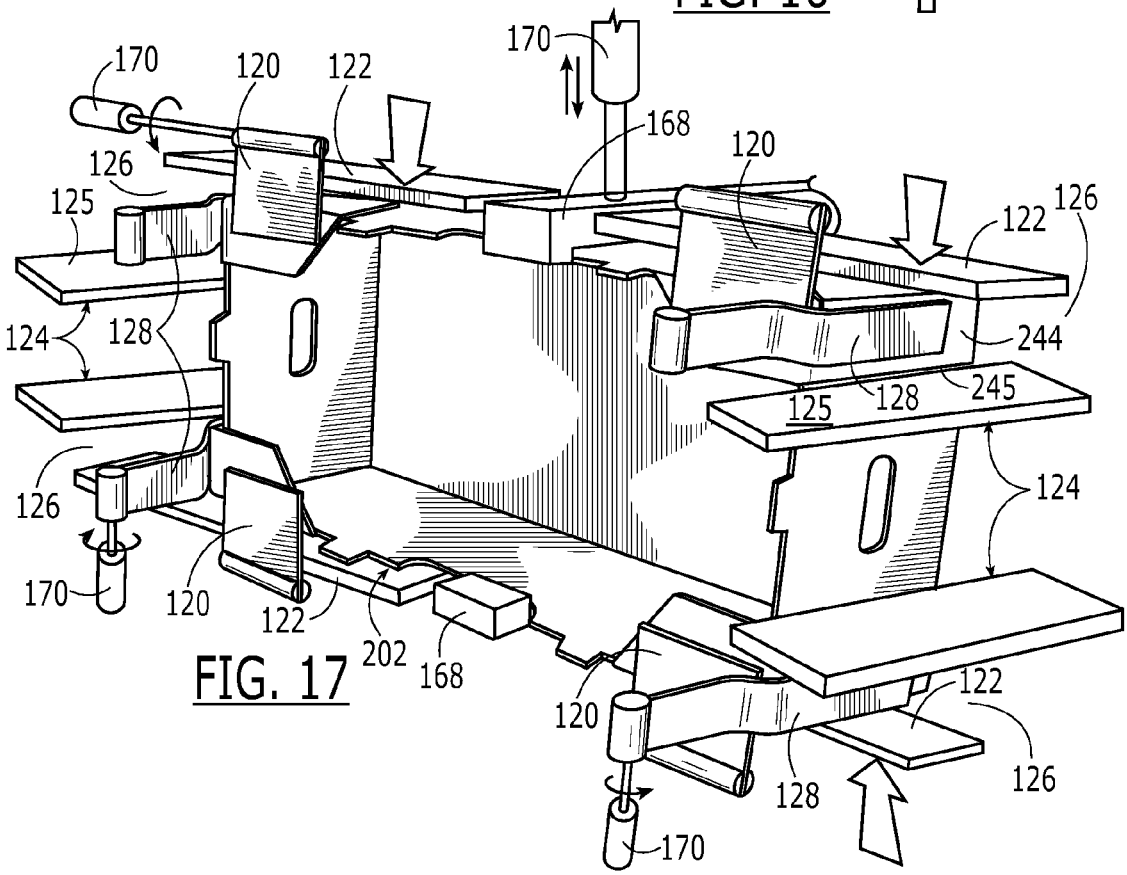
FIG. 17 is a partial perspective view illustrating an orientation of the compression plate, the first folding arm and the second folding arm is a compression orientation for holding corner portions of a fully formed tray.
Figure 18:
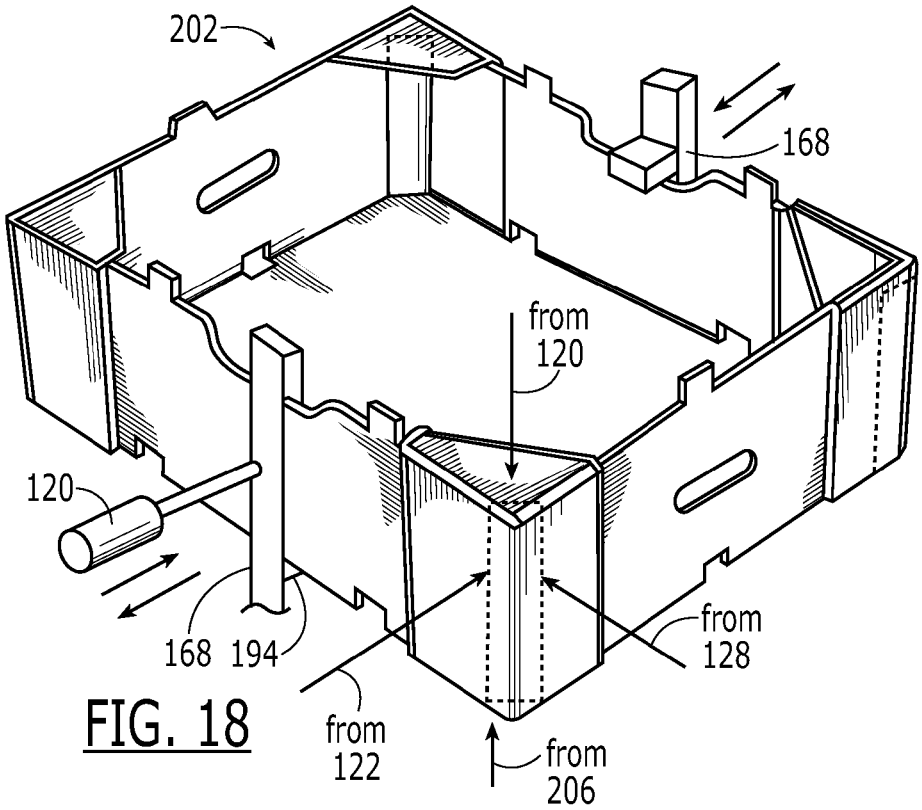
FIG. 18 is a top front perspective view of a fully formed tray formed by the apparatus of FIGS. 1-3.
Figure 19:
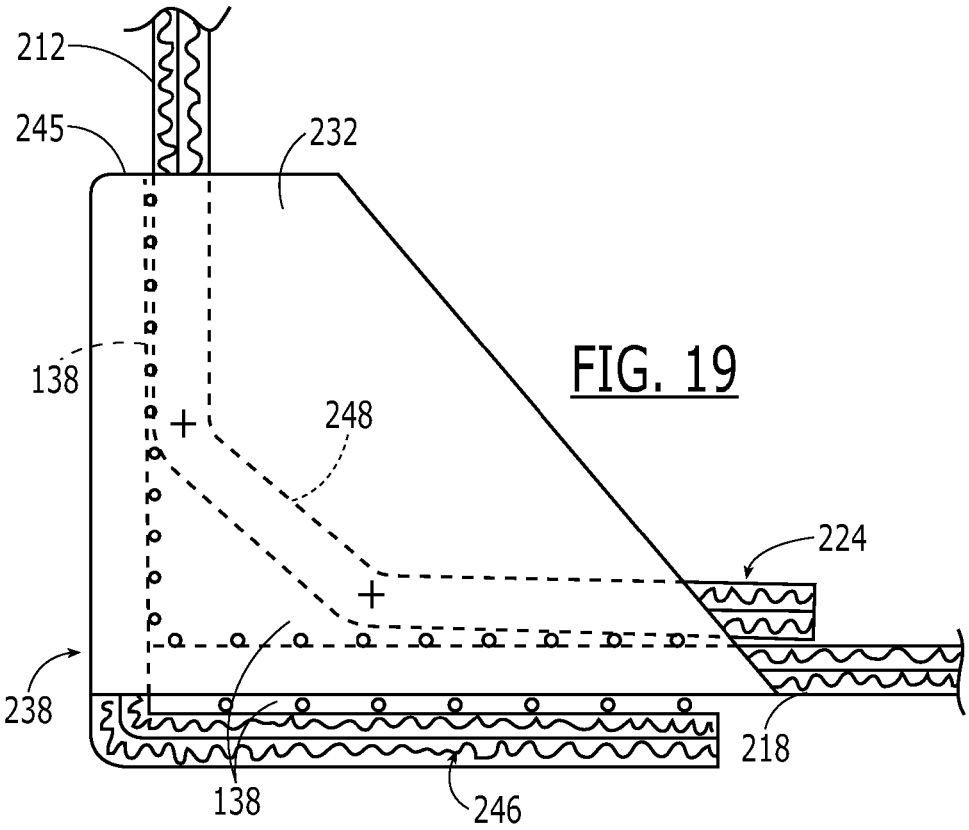
FIG. 19 is a partial enlarged top plan view of one corner portion of the fully formed tray of FIG. 18.

With reference to FIGS. 12-15, a forming of the outside corner support members 238 commences with the second folding arm 128 rotated against the end fold portions 244, folding them about the sixth fold lines 240, and biasing the end fold portions against the end panels 212. As illustrated with reference to FIG. 12, by way of example, an edge 245 of the end fold portion 244 is guided onto the end panel 212 along a surface 125 of the fixed plate 124 for orienting the end fold portion 244 in a preferred orthogonal relation to the bottom panel 210 for enhancing the load bearing strength of the tray 202, as earlier described. A final compression phase includes the compression plate 122 folding of the partially folded side fold portion 246 and compressing thereof as illustrated with reference to FIGS. 16-18. Compression forces act upon each corner of the fully formed tray 202 with the compression plate, the first and second folding arms, and the locking arm each providing opposing forces to compress the adhesive against respective tray surfaces, as further illustrated with reference to FIG. 19 including a partial top view of the double glued wall construction.

As will be understood by those skilled in the art, the controller 148 earlier described with reference to FIG. 1, a controller is operable with drive devices for each of the platen drive, the compression plate, the first folding arm, the second folding arm, and the locking mechanism for a timely movement thereof. With such, the fully formed tray 202 may be released from the frame 112. As illustrated with reference again to FIG. 2, a glue-setting phase may be provided as herein described, by way of example, with reference to a magazine styled frame 172 which receives the fully formed tray 202 stops 174, such as that of the locking arm 168 are released to permit a subsequent tray being formed to push the fully formed and glued tray into the magazine styled frame 172. The magazine styled frame 172 includes framing elements 176 that form an aperture for receiving the tray having an increased outside dimension as a result of the folded corner construction.

As illustrated with reference again to FIG. 2, the apparatus 100 herein described by way of example, carries three trays within the apparatus with a first tray in the forming and compression phase, a second tray being held in the magazine styled frame section for glue setting, and a third tray ready to be ejected when a fourth blank is pushed into position for forming into the partially formed tray.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the claims herein presented.

That which is claimed is:

1. A method of forming a tray from a paperboard blank, the method comprising:

providing a paperboard blank having a plurality of fold lines therein, the blank having a bottom panel, first and second opposing end panels attached to opposing peripheral end portions of the bottom panel at first fold lines, first and second opposing side panels attached to opposing peripheral side portions of the bottom panel at second fold lines, wherein each of the opposing end panels has an inside corner support member attached to opposing edges of each of the opposing end panels at a third fold line, each of the opposing side panels having a top wall portion attached thereto at a fifth fold line, and wherein an outside corner support member is attached to the top wall portion at a sixth fold line, the outside corner support member having a seventh fold line therein for forming an outside corner support having an end fold portion and a side fold portion thereof;

applying an adhesive to a surface of the blank along each of the outside corner support members and portions of the side panels proximate thereto;

biasing a platen against the bottom panel so as to move the blank to a first forming position;

advancing the platen through a forming rail positioned downstream the first forming position for folding the end panels about the first fold lines and the side panels about the second fold lines, wherein each inside corner support member is folded about the third fold line inwardly of the opposing side panels, and wherein the inside corner support member is further folded about the fourth fold line through a biasing of the platen against the corner portion and the forming rail for forming a corner of a partially formed tray;

further advancing the platen downstream and thus the partially formed tray to a second forming position, wherein a distal portion of the forming rail secures the blank into a partially formed tray, and wherein the partially formed tray is configured with the end and side panels positioned generally orthogonal to the bottom panel and each of the inside corner support members folded about the third fold line and in juxtaposition with the side panel portions having the adhesive thereon, and wherein each of the top wall portions and outside corner support members are generally parallel to respective side panels thereof;

retracting the platen from the partially formed tray;

positioning a compression plate in spaced relation and generally parallel to a fixed plate for forming a passage therebetween;

biasing a first folding arm against the top wall portion and folding the top wall portion about the fifth fold line to a position generally parallel to the bottom panel;

biasing a second folding arm against the end fold portion of the outside corner support member and folding the end fold portion about the sixth fold line into the passage and against the end panel, wherein the side fold portion is partially folded about the seventh fold line by contacting the fixed plate providing a guiding surface therefor;

biasing the compression plate against each of the side fold portions for compressing the side fold portions against the side panels thus forming a fully formed;

retracting the compression plate for releasing the biasing on the fully formed tray; and advancing the fully formed tray further downstream.

2. A method according to claim 1, further comprising controlling a space between the fixed plate and the compression plate to be less than a width dimension of the outside corner support member, wherein a partially folded corner support member when folded along the sixth folding line folds to a position against the fixed plate due to the space between the fixed plate and the compression plate.

3. A method according to claim 1, further comprising forming a bevel within the inside corner support member through a folding thereof, wherein the platen includes bevelled corners, and wherein the inside corner support member includes a fourth fold line therein.

4. A method according to claim 1, further comprising locking the partially formed tray in place prior to the platen retracting.

5. A method according to claim 4, further comprising unlocking the fully formed tray for advancing the fully formed tray downstream.

6. A method according to claim 1, further comprising advancing the fully formed tray downstream into a frame for setting the adhesive.

7. A method according to claim 1, wherein the adhesive applying is completed prior to the platen biasing.

8. A method according to claim 7, wherein the adhesive applying provides double glued corner portions formed from a sandwiching of each of the side panels between each of the side fold portions of the outside corner support members and the inside corner support members.

9. A method according to claim 1, wherein the compression plate biasing step follows the first folding arm biasing step.

10. A method according to claim 1, wherein the compression plate biasing step follows the second folding arm biasing step.

11. A method according to claim 1, wherein the compression plate biasing step follows the platen retracting step.

12. A method according to claim 1, further comprising a step of locking the partially formed tray prior to the first folding arm biasing step and maintaining the locking through the compression plate retracting step.

13. A method according to claim 12, further comprising unlocking the partially formed tray following the second folding arm biasing step.

14. A method according to claim 1, wherein the platen further advancing downstream step advancing the partially formed tray to the second forming position, thus causing each inside corner support member to be adhesively attached to the side panels, is completed prior to the platen retracting step.

15. A method according to claim 1, wherein the compression plate biasing step is completed after the platen retracting step.

16. A method according to claim 1, wherein the fixed plate is fixed relative to the end fold portion of the partially formed tray, and wherein the step of the second folding arm biasing against the end fold portion folds the end fold portion along the guiding surface provided by the fixed plate.

* * * * *